US011208709B2

(12) United States Patent
Yang et al.

(10) Patent No.: US 11,208,709 B2
(45) **Date of Patent: *Dec. 28, 2021**

(54) HIGH-STRENGTH STEEL SHEET AND MANUFACTURING METHOD THEREFOR

(71) Applicant: JFE Steel Corporation, Tokyo (JP)

(72) Inventors: Lingling Yang, Tokyo (JP); Noriaki Kohsaka, Tokyo (JP); Tatsuya Nakagaito, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 203 days.

This patent is subject to a terminal disclaimer.

(21) Appl. No.: 16/488,301

(22) PCT Filed: Feb. 21, 2018

(86) PCT No.: PCT/JP2018/006173

§ 371 (c)(1),
(2) Date: Aug. 23, 2019

(87) PCT Pub. No.: WO2018/159405

PCT Pub. Date: Sep. 7, 2018

(65) Prior Publication Data

US 2020/0232073 A1 Jul. 23, 2020

(30) Foreign Application Priority Data

Feb. 28, 2017 (JP) ..... JP2017-036394

(51) Int. Cl.
*C22C 38/04* (2006.01)
*C22C 38/02* (2006.01)
(Continued)

(52) U.S. Cl.
CPC ..... *C22C 38/04* (2013.01); *C21D 8/0205* (2013.01); *C21D 8/0226* (2013.01);
(Continued)

(58) Field of Classification Search
CPC ..... C21D 2211/002; C21D 2211/005; C21D 2211/008; C21D 8/0205; C21D 8/0226;
(Continued)

(56) References Cited

U.S. PATENT DOCUMENTS

2005/0167007 A1 8/2005 Miura et al.
2010/0132849 A1* 6/2010 Takagi ..... C22C 38/22 148/533

(Continued)

FOREIGN PATENT DOCUMENTS

EP 2762579 A1 8/2014
EP 3050989 A1 8/2016

(Continued)

OTHER PUBLICATIONS

Internation Search Report and Written Opinion for International Application No. PCT/JP2018/006173 dated May 29, 2019. 5 Pages.

(Continued)

*Primary Examiner* — Jenny R Wu
(74) *Attorney, Agent, or Firm* — RatnerPrestia

(57) ABSTRACT

Provided are a high-strength steel sheet having a yield strength of 550 MPa or higher and having a small amount of springback and width-direction uniformity in material properties as well as a manufacturing method therefor.

The high-strength steel sheet has a yield strength (YP) of 550 MPa or higher and has a specific component composition and a microstructure containing a ferrite phase, 40 to 70% of a martensite phase in area ratio, and 5 to 30% of a bainite phase in area ratio, where: an average grain size of the martensite phase is 2 to 8 μm and an average grain size of the ferrite phase is 11 μm or less on a cross-section in the thickness direction and in a direction orthogonal to a rolling direction; and the average grain size of the ferrite phase is 3.0 times or less the average grain size of martensite.

20 Claims, 1 Drawing Sheet

(51) Int. Cl.

| | |
|---|---|
| ***C22C 38/00*** | (2006.01) |
| ***C22C 38/06*** | (2006.01) |
| ***C22C 38/08*** | (2006.01) |
| ***C22C 38/10*** | (2006.01) |
| ***C22C 38/12*** | (2006.01) |
| ***C22C 38/14*** | (2006.01) |
| ***C22C 38/16*** | (2006.01) |
| ***C22C 38/32*** | (2006.01) |
| ***C22C 38/60*** | (2006.01) |
| ***C21D 8/02*** | (2006.01) |
| ***C23C 2/00*** | (2006.01) |

(52) U.S. Cl.
CPC ..... *C21D 8/0236* (2013.01); *C21D 8/0273* (2013.01); *C22C 38/002* (2013.01); *C22C 38/005* (2013.01); *C22C 38/008* (2013.01); *C22C 38/02* (2013.01); *C22C 38/06* (2013.01); *C22C 38/08* (2013.01); *C22C 38/10* (2013.01); *C22C 38/12* (2013.01); *C22C 38/14* (2013.01); *C22C 38/16* (2013.01); *C22C 38/32* (2013.01); *C22C 38/60* (2013.01); *C23C 2/00* (2013.01); *C21D 2211/002* (2013.01); *C21D 2211/005* (2013.01); *C21D 2211/008* (2013.01)

(58) Field of Classification Search
CPC ..... C21D 8/0236; C21D 8/0273; C21D 9/46; C22C 38/00; C22C 38/002; C22C 38/005; C22C 38/008; C22C 38/02; C22C 38/04; C22C 38/06; C22C 38/08; C22C 38/10; C22C 38/12; C22C 38/14; C22C 38/16; C22C 38/18; C22C 38/22; C22C 38/28; C22C 38/32; C22C 38/34; C22C 38/60; C23C 2/00
See application file for complete search history.

(56) References Cited

U.S. PATENT DOCUMENTS

| | | | | |
|---|---|---|---|---|
| 2013/0206288 | A1 | 8/2013 | Kaneko et al. | |
| 2014/0212684 | A1 | 7/2014 | Kawata et al. | |
| 2016/0312329 | A1 * | 10/2016 | Hasegawa | C22C 38/00 |
| 2018/0127856 | A1 | 5/2018 | Takashima et al. | |

FOREIGN PATENT DOCUMENTS

| | | | | |
|---|---|---|---|---|
| JP | 2005213640 | A | 8/2005 | |
| JP | 2011111671 | A | 6/2011 | |
| JP | 4893844 | B2 | 3/2012 | |
| JP | 2014196557 | A | 10/2014 | |
| WO | 2013018739 | | 2/2013 | |
| WO | WO-2015092982 | A1 * | 6/2015 | B32B 15/013 |
| WO | 2016135794 | A1 | 9/2019 | |

OTHER PUBLICATIONS

Extended European Search Report for European Application No. 18 760 449.1, dated Nov. 6, 2019, 10 pages.
Chinese Office Action with Search Report for Chinese Application No. 201880013908.2, dated Sep. 29, 2020, with Concise of Office Action, 8 pages.
Korean Office Action for Korean Application No. 10-2019-7024536, dated Oct. 23, 2020 with Concise of Office Action, 6 pages.

* cited by examiner

HIGH-STRENGTH STEEL SHEET AND MANUFACTURING METHOD THEREFOR

CROSS REFERENCE TO RELATED APPLICATIONS

This is the U.S. National Phase application of PCT/JP2018/006173, filed Feb. 21, 2018, which claims priority to Japanese Patent Application No. 2017-036394, filed Feb. 28, 2017, the disclosures of these applications being incorporated herein by reference in their entireties for all purposes.

FIELD OF THE INVENTION

The present invention relates to a high-strength steel sheet used primarily for automotive parts and to a manufacturing method therefor. Particularly, the present invention relates to a high-strength steel sheet having a yield strength of 550 MPa or higher and having excellent width-direction uniformity in material properties and to a manufacturing method therefor.

BACKGROUND OF THE INVENTION

In recent years, in view of global environmental protection, improving automobile fuel efficiency for the purpose of reduced $CO_2$ emission has always been an important challenge in industries concerning moving vehicles, for example, in the automobile industry. To enhance automobile fuel efficiency, reducing the weight of automobile bodies is effective. Weight reduction of automobile bodies requires a reduction in the weight of automobile bodies while maintaining the strength of automobile bodies. In such a case, if the strength of steel sheets to be used as raw materials for automotive parts can be increased so as to reduce the weight of parts through thinning of the raw materials and/or if the number of parts is decreased through simplification of the structure, it is possible to achieve weight reduction of automobile bodies.

However, the majority of automobile parts, whose raw materials are steel sheets, are formed by press working and the like. Thus, steel sheets to be used as raw materials for automotive parts are required to have high strength. Moreover, when a steel sheet having partially varying strength is press-formed, the amount of springback varies in proportion to the strength, thereby causing a phenomenon in which a part is twisted. Accordingly, to obtain a part having desirable strength as well as dimensional and shape accuracy, it is also extremely important that a steel sheet to be used as a raw material have uniform strength and workability in the width direction.

Patent Literature 1 discloses a high-strength cold-rolled steel sheet of 980 MPa or higher having excellent steel sheet shape and shape fixability and a manufacturing method therefor. Moreover, Patent Literature 2 discloses a high-strength cold-rolled steel sheet having excellent elongation and stretch flangeability and a manufacturing method therefor. Further, Patent Literature 3 discloses a high-strength hot-dip galvanized steel sheet having excellent formability and impact resistance and a manufacturing method therefor.

PATENT LITERATURE

PTL 1: Japanese Unexamined Patent Application Publication No. 2014-196557

PTL 2: Japanese Unexamined Patent Application Publication No. 2005-213640

PTL 3: Japanese Unexamined Patent Application Publication No. 4893844

SUMMARY OF THE INVENTION

In all of the high-strength steel sheets disclosed in Patent Literature 1, Patent Literature 2, and Patent Literature 3, when a difference in size between a martensite phase (including tempered martensite) and a ferrite phase becomes large despite a small difference in hardness therebetween, the amount of springback varies in forming a part, thereby causing a phenomenon in which the part is twisted. Hence, a problem remains for actual use.

As described above, all of the conventional techniques still have a problem with uniformity in material properties. Aspects of the present invention are intended to advantageously resolve the above-mentioned problem of the conventional techniques, and an object according to aspects of the present invention is to provide a high-strength steel sheet having a yield strength of 550 MPa or higher and having a small amount of springback and width-direction uniformity in material properties and to also provide a manufacturing method therefor.

To achieve the above-mentioned object, the present inventors intensively studied the microstructure of steel and as a result obtained the following findings.

(1) Width-direction variations in material properties are readily affected by a microstructure observable on a cross-section in the thickness direction and in a direction orthogonal to the rolling direction.

(2) Width-direction variations in material properties tend to arise due to uneven temperature, such as an annealing temperature or a temperature by which a cooling rate is adjusted. The above-mentioned variations in material properties can be suppressed by employing a specific component composition and a specific manufacturing method so as to have a specific microstructure on a cross-section in the thickness direction exposed upon cutting of a steel sheet in a direction orthogonal to the rolling direction.

(3) When a martensite phase and a ferrite phase coarsen, a hard portion and a soft portion are generated locally, and consequently, width-direction variations in material properties tend to increase.

Aspects of the present invention have been completed on the basis of the above-described findings, and are as follows.

[1] A high-strength steel sheet having a yield strength (YP) of 550 MPa or higher and having: a component composition containing, in mass %, C: 0.05 to 0.15%, Si: 0.010 to 2.0%, Mn: 1.8 to 3.2%, P: 0.05% or less, S: 0.02% or less, Al: 0.01 to 2.0%, and Mo: 0.03 to 0.50%, with the balance being Fe and incidental impurities; and a microstructure containing a ferrite phase, 40 to 70% of a martensite phase in area ratio, and 5 to 30% of a bainite phase in area ratio, where: an average grain size of the martensite phase is 2 to 8 μm and an average grain size of the ferrite phase is 11 μm or less on a cross-section in the thickness direction and in a direction orthogonal to a rolling direction; and the average grain size of the ferrite phase is 3.0 times or less the average grain size of martensite.

[2] The high-strength steel sheet according to [1], where the component composition further contains, in mass %, B: 0.0001 to 0.005%.

[3] The high-strength steel sheet according to [1] or [2], where the component composition further contains, in mass %, Ti: 0.005 to 0.04%.

[4] The high-strength steel sheet according to any one of [1] to [3], where the component composition further contains, in mass %, Cr: 1.0% or less.

[5] The high-strength steel sheet according to any one of [1] to [4], where the component composition further contains, in mass %, 1% or less in total of any one or more of Cu, Ni, Sn, As, Sb, Ca, Mg, Pb, Co, Ta, W, REM, Zn, Sr, Cs, Hf, V, and Nb.

[6] The high-strength steel sheet according to any one of [1] to [5], where the steel sheet has a coated layer on a surface.

[7] The high-strength steel sheet according to [6], where the coated layer is a hot-dip galvanized layer.

[8] A manufacturing method for a high-strength steel sheet, including an annealing step of: heating a cold-rolled steel sheet having the component composition according to any one of [1] to [5] to an annealing temperature under conditions of an average heating rate of 10° C./s or more in a temperature range of ($A_{c1}$−50° C.) to $A_{c1}$; annealing under conditions of an annealing temperature of 750° C. to 900° C. for an annealing time of 30 to 200 seconds; cooling to 400° C. to 600° C. at an average cooling rate of 10° C./s to 40° C./s; and performing, during the cooling, bending-unbending two times or more and six times or less in total by using a roll having a radius of 100 mm or more.

[9] The manufacturing method for a high-strength steel sheet according to [8], further including, after the annealing step, a coating step of performing a coating process.

A high-strength steel sheet according to aspects of the present invention has a yield strength of 550 MPa or higher and has excellent width-direction uniformity in material properties.

DETAILED DESCRIPTION OF EMBODIMENTS OF THE INVENTION

Figure 1:
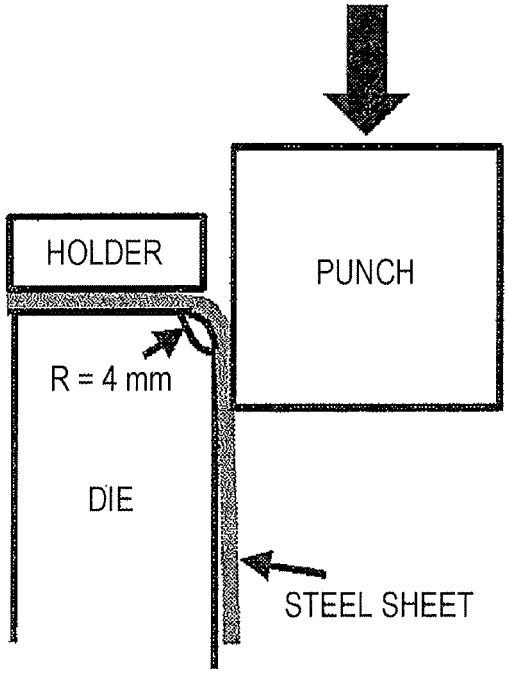
FIG. 1 is a schematic view for illustrating the measurement of a springback angle.

Hereinafter, embodiments of the present invention will be described. The present invention, however, is not limited to the following embodiments.

The component composition of a high-strength steel sheet according to aspects of the present invention will be described. In the description hereinafter, the symbol "%" as a unit of the content of each component means mass %.

C: 0.05 to 0.15%

C is an essential element for forming a martensite phase and increasing strength. When C content is less than 0.05%, the hardness of a martensite phase decreases without achieving a yield strength of 550 MPa or higher. Meanwhile, when C content exceeds 0.15%, a large amount of cementite is formed, thereby impairing ductility. In addition, width-direction variations in material properties increase. Accordingly, C content is set to 0.05 to 0.15%. The lower limit is set to preferably 0.06% or more, more preferably 0.07% or more, and further preferably 0.08% or more. Meanwhile, the upper limit is set to preferably 0.14% or less, more preferably 0.12% or less, and further preferably 0.10% or less.

Si: 0.010 to 2.0%

Si is an element that acts to increase the hardness of a steel sheet through solid solution strengthening. To ensure high yield strength in a stable manner, Si content is set to 0.010% or more. Meanwhile, when Si content exceeds 2.0%, cementite is finely precipitated within a martensite phase, thereby impairing ductility. In addition, width-direction variations in material properties increase. Accordingly, Si content is set to 2.0% or less. The lower limit is preferably 0.3% or more, more preferably 0.5% or more, and further preferably 0.7% or more. Meanwhile, the upper limit is preferably 1.80% or less, more preferably 1.70% or less, and further preferably 1.60% or less.

Mn: 1.8 to 3.2%

Mn is an element that acts to increase the hardness of a steel sheet through solid solution strengthening. Mn is also an element that forms a martensite phase while suppressing ferrite transformation, thereby increasing the strength of a raw material. To ensure high yield strength in a stable manner, Mn content of 1.8% or more is required. Mn content is preferably 2.0% or more, more preferably 2.1% or more, and further preferably 2.2% or more. Meanwhile, when Mn content increases, formability deteriorates due to a segregated layer and/or width-direction variations in material properties increase. Accordingly, Mn content is set to 3.2% or less. Mn content is preferably 3.0% or less, more preferably 2.8% or less, and further preferably 2.7% or less.

P: 0.05% or Less

P is segregated at grain boundaries, thereby impairing ductility. Accordingly, P content is set to 0.05% or less, preferably 0.03% or less, and further desirably 0.02% or less. Meanwhile, the lower limit of P content is not particularly limited, but is preferably 0.0001% or more in view of manufacturing costs.

S: 0.02% or Less

S bonds with Mn to form coarse MnS, thereby impairing ductility. Accordingly, S content is preferably decreased as much as possible. In accordance with aspects of the present invention, S content may be 0.02% or less. S content is preferably 0.01% or less and further preferably 0.002% or less. Meanwhile, the lower limit of S content is not particularly limited, but is preferably 0.0001% or more in view of manufacturing costs.

Al: 0.01 to 2.0%

Deoxidation is important since the presence of a large amount of oxides in steel decreases ductility. In addition, Al suppresses precipitation of cementite in some cases. To obtain such effects, Al content of 0.01% or more is required. Meanwhile, when Al content exceeds 2.0%, oxides and/or nitrides aggregate and coarsen, thereby impairing ductility. Accordingly, Al content is set to 2.0% or less. The lower limit is preferably 0.02% or more, more preferably 0.03% or more, and further preferably 0.05% or more. Meanwhile, the upper limit is preferably 1.5% or less and more preferably 0.1% or less.

Mo: 0.03 to 0.50%

In accordance with aspects of the present invention, Mo is an important element for decreasing width-direction variations in material properties. Mo promotes austenite nucleation, thereby achieving refinement of martensite. In addition, grain boundary segregation of Mo results in refinement of ferrite. To obtain such effects, Mo content of 0.03% or more is required. Mo content is preferably 0.05% or more, more preferably 0.07% or more, and further preferably 0.10% or more. Meanwhile, when Mo content exceeds 0.50%, diffusion of C within austenite is suppressed due to strong interactions between Mo and C, thereby suppressing bainite transformation. Moreover, carbides are precipitated and ductility deteriorates. Accordingly, Mo content is preferably 0.40% or less, more preferably 0.35% or less, and further preferably 0.30% or less.

In addition to the above-described basic components, the following components (optional components) may be contained.

B: 0.0001 to 0.005%

B is an element useful for suppressing formation of a pearlite phase from an austenite phase and for ensuring a desirable martensite fraction (martensite area ratio). To fully obtain such effects, B content of 0.0001% or more is required. B content is preferably 0.0010% or more and more preferably 0.0015% or more. Meanwhile, when B content exceeds 0.005%, B forms $Fe_{23}(CB)_6$, thereby impairing ductility. Accordingly, B content is set to 0.005% or less. B content is preferably 0.004% or less, more preferably 0.003% or less, and further preferably 0.0020% or less.

Ti: 0.005 to 0.04%

Ti bonds with N to form a nitride while suppressing formation of BN, thereby deriving the effects of B. At the same time, formation of TiN causes refinement of crystal grains, thereby increasing toughness. To fully obtain such effects, Ti content of 0.005% or more is required. Ti content is preferably 0.01% or more. Meanwhile, when Ti content exceeds 0.04%, not only do such effects level off, but also a rolling load increases, thereby making stable manufacture of steel sheets difficult. Accordingly, Ti content is set to 0.04% or less and preferably 0.03% or less.

Cr: 1.0% or Less

Cr is an element that effectively suppresses temper embrittlement. Accordingly, by incorporating Cr, the effects according to aspects of the present invention further increase. To obtain such an effect, Cr is contained preferably at 0.005% or more and more preferably 0.010% or more. Meanwhile, when Cr content exceeds 1.0%, Cr carbide is formed and ductility deteriorates. Accordingly, if contained, Cr content is set to 1.0% or less, preferably 0.5% or less, and more preferably 0.2% or less.

Further, a high-strength steel sheet according to aspects of the present invention may contain 1% or less in total of any one or more of Cu, Ni, Sn, As, Sb, Ca, Mg, Pb, Co, Ta, W, REM, Zn, Sr, Cs, Hf, V, and Nb. The content is preferably 0.1% or less and more preferably 0.03% or less. The lower limit is not particularly limited, but is preferably 0.001% or more in total. Components other than those above-described are Fe and incidental impurities. Here, when a lower limit of the content is set to any of the above-described optional components, an optional element contained at less than the lower limit does not impair the effects according to aspects of the present invention. Any of the above-described optional elements contained at less than the lower limit is regarded to be contained as an incidental impurity.

Next, the microstructure of a high-strength steel sheet according to aspects of the present invention will be described.

The microstructure of a high-strength steel sheet according to aspects of the present invention is a microstructure identified through observation of a cross-section in the thickness direction exposed upon cutting of the steel sheet in the width direction (a direction orthogonal to the rolling direction). Specifically, the microstructure has the following characteristics.

Bainite Phase

The microstructure of a high-strength steel sheet according to aspects of the present invention contains, in area ratio, 5 to 30% of a bainite phase. Since a bainite phase is formed from austenite grain boundaries, formation of a bainite phase is effective for refinement of a martensite phase. Moreover, the strength of a bainite phase is between that of martensite and that of ferrite. Accordingly, a bainite phase acts to decrease variations in material properties due to differences in workability and hardness. To obtain such effects sufficiently, an area fraction (area ratio) of a bainite phase of 5% or more is required. The area ratio is preferably 9% or more and more preferably 11% or more. Meanwhile, when an area ratio of a bainite phase exceeds 30%, a martensite fraction decreases and a yield strength of 550 MPa or higher cannot be achieved. Accordingly, an area ratio of a bainite phase is set to 30% or less, preferably 25% or less, and more preferably 20% or less.

Martensite Phase

The microstructure of a high-strength steel sheet according to aspects of the present invention contains, in area ratio, 40 to 70% of a martensite phase. A martensite phase is a hard phase and acts to increase the strength of a steel sheet through transformation strengthening. To achieve a yield strength of 550 MPa or higher, an area fraction (area ratio) of a martensite phase of 40% or more is required. The area ratio is preferably 45% or more and more preferably 50% or more. Meanwhile, when an area ratio of a martensite phase exceeds 70%, a hard phase locally coarsens, thereby impairing uniformity in material properties. Accordingly, an area ratio of a martensite phase is set to 70% or less, preferably 65% or less, and more preferably 60% or less. Here, a martensite phase encompasses both a tempered martensite phase and an as-quenched martensite phase. The total of the bainite and martensite phases is preferably 55% or more.

In the above-described microstructure, an average grain size of the martensite phase is set to 2 to 8 μm. To achieve a yield strength of 550 MPa or higher, an average grain size of the martensite phase of 2 μm or more is required. The average grain size is preferably 4 μm or more and more preferably 5 μm or more. Meanwhile, when an average grain size of the martensite phase exceeds 8 μm, a hard phase coarsens locally, thereby impairing uniformity in material properties. Accordingly, an average grain size of the martensite phase is set to 8 μm or less and preferably 7 μm or less.

An area ratio of the above-mentioned ferrite phase is not particularly limited, but is preferably 5 to 40%. The area ratio of 5% or more is preferable since a ferrite phase has excellent workability. The area ratio is more preferably 11% or more and further preferably 15% or more. When the area ratio of a ferrite phase exceeds 40%, there is a possibility that yield strength may become 550 MPa or lower. Accordingly, the area ratio is more preferably 35% or less.

Moreover, an average grain size of a ferrite phase contained in the above-described microstructure is set to 11 μm or less. When the average grain size of a ferrite phase exceeds 11 μm, the strength of a steel sheet decreases and the toughness also deteriorates. In addition, a soft phase coarsens locally, thereby impairing uniformity in material properties. Accordingly, the average grain size of a ferrite phase is set to 11 μm or less. The lower limit of the average grain size is preferably 3 μm or more, more preferably 4 μm or more, and further preferably 5 μm or more. Meanwhile, the upper limit of the average grain size is preferably 10 m or less, more preferably 9 μm or less, and further preferably 8 μm or less.

Average Grain Size of Ferrite Phase of 3.0 Times or Less Average Grain Size of Martensite A large difference in average grain size between a ferrite phase and martensite results in a locally coarsened hard phase and/or soft phase, deteriorated uniformity in material properties, and increased width-direction variations in material properties. Accordingly, the average grain size of a ferrite phase is set to 3.0 times or less, preferably 2.5 times or less, and more preferably 2.0 times or less the average grain size of martensite. The lower limit is preferably 1.0 time or more and more preferably 1.2 times or more.

In accordance with aspects of the present invention, the above-described microstructure contains a bainite phase, a martensite phase, and a ferrite phase, but may contain other phases. Examples of the other phases include pearlite and retained austenite. A total area ratio of the other phases is preferably 8% or less.

Measurement Method

The average grain size of a martensite phase and the average grain size of a ferrite phase are determined by observing a ¼ thickness portion of a cross-section in the thickness direction (C cross-section) exposed upon cutting of a steel sheet in a direction perpendicular (a direction orthogonal) to the rolling direction. Specifically, the average grain sizes are obtained by imaging ten fields of view of a microstructure exposed through etching with 1% Nital under a scanning electron microscope (SEM) at a magnification of 2,000× and by employing intercept procedures in accordance with ASTM E 112-10. A ferrite phase is a microstructure in which no etch mark or cementite is observed inside the grains, and a bainite phase is a microstructure in which etch marks and/or large carbides are observed inside the grains. In untempered martensite, no cementite is observed inside the grains, and the gradation is brighter than that of a ferrite phase. Tempered martensite is a microstructure in which etch marks and/or cementite are observed inside the grains. For these phases, an average area ratio relative to the observed fields of view is obtained by image analysis. Here, to distinguish martensite and retained austenite, measurement of retained austenite is performed by quantifying a volume ratio of a retained austenite phase by using X-ray diffraction intensities of a surface prepared through grinding of a cold-rolled steel sheet or a base steel sheet of a hot-dip galvanized steel sheet to a ¼ position in the thickness direction and then through chemical polishing of 200 μm or more. MoKα radiation is used as an incident source, and the volume ratio is measured from (200)α, (211)α, (220)α, (200)γ, (220)γ, and (311)γ peaks. The obtained volume ratio value of the retained austenite phase is regarded as an area ratio value thereof in the steel sheet microstructure. A martensite area ratio in accordance with aspects of the present invention is regarded as a value obtained by subtracting an area ratio of retained austenite from an area ratio of untempered martensite and by adding an area ratio of tempered martensite. An area ratio of each phase can also be obtained from the above-mentioned SEM images.

A high-strength steel sheet having the above-described component composition and microstructure may have a coated layer on the surface. The type of the coated layer is not particularly limited, but is preferably a hot-dip galvanized layer. Moreover, a galvannealed layer formed through an alloying treatment is also preferable.

Next, a manufacturing method for a high-strength steel sheet according to aspects of the present invention will be described.

The manufacturing method for a high-strength steel sheet according to aspects of the present invention may use a cold-rolled steel sheet as a starting material. In the description hereinafter, an exemplary method of manufacturing a cold-rolled steel sheet from steel will also be described.

A manufacturing method for a high-strength steel sheet described hereinafter includes a hot rolling step, a cold rolling step, an annealing step, and a coating step.

First, steel used in the hot-rolling step will be described. A refining method for steel is not particularly limited and may employ a publicly known refining method, such as by using a converter or an electric furnace. After refining, a slab (steel) is preferably obtained by a continuous casting method, in view of problems, such as segregation. In accordance with aspects of the present invention, a slab may also be obtained by a publicly known casting method, such as an ingot casting/slabbing method or a thin slab continuous casting method. In hot rolling of a slab after casting, the slab may be rolled after reheating in a heating furnace or the slab may undergo direct rolling without heating when a predetermined temperature or a higher temperature is maintained.

Hot Rolling Step

The steel obtained as above undergoes roughening and finish rolling. In accordance with aspects of the present invention, it is required that carbides in steel be dissolved before roughening. When a slab is heated, heating to 1,100° C. or higher is preferable to dissolve carbides and/or to prevent an increase in rolling load. Meanwhile, to prevent an increase in scale loss, the heating temperature of a slab is preferably 1,300° C. or lower. As in the foregoing, when steel before roughening maintains a predetermined temperature or a higher temperature and when carbides in steel are dissolved, heating treatment of steel before roughening can be omitted. Here, roughening conditions are not required to be particularly limited.

Cold Rolling Step

In the cold rolling step, a hot-rolled steel sheet obtained in the hot rolling step is cold-rolled. A reduction ratio in cold rolling is not particularly limited and may be set appropriately.

Annealing Step In the annealing step, a cold-rolled steel sheet having the above-described component composition (a cold-rolled steel sheet obtained by using steel having the above-described component composition) is first heated to an annealing temperature under conditions of an average heating rate of 10° C./s or more in the temperature range of ($A_{c1}$−50° C.) to $A_{c1}$. Refinement of a martensite phase requires promotion of nucleation of an austenite phase. Promoting nucleation of an austenite phase requires an increase in the average heating rate in [$A_{c1}$ point (ferrite-to-austenite transformation start temperature)−50° C.] to $A_{c1}$. When an average heating rate in ($A_{c1}$−50° C.) to $A_{c1}$ is less than 10° C./s, nucleation of an austenite phase is insufficient and, consequently, the grain size of a martensite phase in the final microstructure coarsens. The upper limit is not particularly limited, but is preferably 30° C./s or less. Here, $A_{c1}$ can be obtained by using the formula below. In the formula, an atomic symbol represents the content (mass %) of each element and is set to zero if not contained.

$$A_{c1}(^\circ\text{ C.})=723+29.1\text{Si}-10.7\text{Mn}-16.9\text{Ni}+16.9\text{Cr}$$

Next, annealing is performed under conditions of an annealing temperature of 750° C. to 900° C. and an annealing time of 30 to 200 seconds. Obtaining a microstructure that contains, in volume fraction, 40 to 70% of a martensite phase and that has an average grain size of the martensite phase of 2 to 8 μm and an average grain size of a ferrite phase of 11 μm or less requires a steel sheet to be annealed after cold rolling by retaining at an annealing temperature of 750° C. to 900° C. for 30 to 200 seconds. When the annealing temperature is lower than 750° C. and/or the retention time is less than 30 seconds, a ferrite fraction increases without containing desirable amounts of bainite and martensite phases in the final microstructure. Meanwhile, when the annealing temperature exceeds 900° C., a volume fraction of martensite increases, thereby impairing uniformity in material properties. Moreover, when the annealing time exceeds 200 seconds, ductility deteriorates in some cases due to precipitation of a large amount of iron carbide. In addition, width-direction variations in material properties increase. Accordingly, the annealing temperature is set to 750° C. to 900° C., and the annealing time is set to 30 to 200 seconds. The lower limit of the annealing temperature is preferably 800° C. or higher, and the upper limit of the annealing temperature is preferably 900° or lower. The lower limit of the annealing time is preferably set to 50 seconds or more, and the upper limit of the annealing time is preferably set to 150 seconds or less.

Subsequently, cooling to 400° C. to 600° C. is performed at an average cooling rate of 10° C./s to 40° C./s. Cooling to lower than 400° C. results in increased tempered martensite and decreased strength. Meanwhile, when the cooling termination temperature exceeds 600° C., the growth of ferrite grains progresses, thereby decreasing strength. When an average cooling rate is less than 10° C./s, ferrite grains coarsen, thereby decreasing strength. Accordingly, the average cooling rate is 10° C./s or more. Meanwhile, when the cooling rate exceeds 40° C./s, bainite is less likely to be formed, thereby increasing variations in material properties due to differences in workability and hardness. Accordingly, the cooling rate is set to 10° C./s to 40° C./s and preferably 30° C./s or less.

Further, bending-unbending is performed, during the cooling, two times or more and six times or less in total by using a roll having a radius of 100 mm or more. To achieve an average grain size of a martensite phase of 2 to 8 μm and an average grain size of a ferrite phase of 11 μm or less, suppressed grain growth is required during cooling after annealing. Moreover, this bending-unbending process is effective to decrease width-direction variations in material properties. Accordingly, two times or more and six times or less of bending-unbending is required during the above-described cooling. When bending-unbending is performed by using a roll having a radius of less than 100 mm or when bending-unbending is performed less than two times, desirable grain sizes cannot be achieved. In addition, variations in material properties cannot be decreased satisfactorily. Accordingly, the roll radius is set to 100 mm or more, and the number of times of bending-unbending is set to two or more. Meanwhile, when bending-unbending is performed more than six times, a martensite phase tends to harden, thereby impairing uniformity in material properties. Accordingly, bending-unbending is set to be performed six times or less and preferably four times or less. Herein, two times or more in total of bending-unbending means that the total of the number of times of bending and the number of times of unbending is two or more.

When bending-unbending is performed, sheet thickness is not particularly limited but is typically 0.5 to 2.6 mm.

A coating step of performing the coating process described below may be performed after the above-described annealing step. The type of the coating process is not particularly limited and may be either an electroplating process or a hot-dip coating process. Further, an alloying treatment may be performed after the hot-dip coating process. Preferably, the type of the coating process is a hot-dip galvanizing process or a galvannealing process in which an annealing treatment is performed after a hot-dip galvanizing process. Here, the coating process may be performed after the cooling to 400° C. to 600° C. in the above-described annealing step has been terminated or the coating process may be performed following further cooling.

EXAMPLES

Slabs each having the component composition shown in Table 1 underwent hot rolling, cold rolling, and annealing under the conditions shown in Table 2 to manufacture 1.2 mm-thick steel sheets. To investigate width-direction uniformity in material properties, samples were taken from a central portion and a portion at a position 50 mm from the end in the width direction, and variations in properties were examined. The uniformity was evaluated as absolute differences in material properties between those of the central portion and the end portion in the width direction. The examination method is as follows.

TABLE 1

| Steel | Component composition (mass %) | | | | | | | | | |
|---|---|---|---|---|---|---|---|---|---|---|
| symbol | C | Si | Mn | P | S | Al | B | Ti | Mo | Others |
| A | 0.078 | 1.52 | 2.26 | 0.01 | 0.001 | 0.03 | 0.002 | 0.02 | 0.11 | — |
| B | 0.071 | 1.36 | 2.41 | 0.01 | 0.002 | 0.03 | 0.002 | — | 0.17 | Zn: 0.05, Sr: 0.008 |
| C | 0.055 | 1.72 | 2.51 | 0.01 | 0.003 | 0.05 | — | 0.02 | 0.07 | Nb: 0.02 |
| D | 0.112 | 1.48 | 1.89 | 0.01 | 0.012 | 0.02 | 0.005 | 0.02 | 0.06 | Mg: 0.004, Ta: 0.026 |
| E | 0.042 | 1.5 | 2.61 | 0.02 | 0.010 | 0.05 | 0.002 | 0.02 | 0.32 | — |
| F | 0.179 | 1.33 | 2.06 | 0.02 | 0.009 | 0.04 | 0.001 | 0.01 | 0.08 | — |
| G | 0.06 | 1.62 | 2.36 | 0.02 | 0.010 | 0.04 | 0.003 | 0.01 | 0.10 | Cr: 0.02 |
| H | 0.091 | 1.48 | 2.42 | 0.02 | 0.010 | 1.52 | 0.001 | 0.01 | 0.05 | — |
| I | 0.069 | 1.62 | 2.31 | 0.01 | 0.008 | 0.04 | 0.003 | 0.03 | 0.15 | Pb: 0.01, Ta: 0.005 |
| J | 0.055 | 2.13 | 2.45 | 0.01 | 0.012 | 0.03 | 0.002 | 0.03 | 0.04 | — |
| K | 0.056 | 0.007 | 2.56 | 0.02 | 0.009 | 0.02 | 0.002 | 0.01 | 0.10 | — |
| L | 0.088 | 1.34 | 2.40 | 0.02 | 0.015 | 0.03 | 0.001 | 0.02 | 0.12 | Hf: 0.010, Cs: 0.002 |
| M | 0.069 | 1.53 | 1.62 | 0.01 | 0.007 | 0.03 | 0.003 | 0.02 | 0.14 | — |
| N | 0.069 | 1.53 | 3.58 | 0.01 | 0.009 | 0.03 | 0.001 | 0.03 | 0.15 | — |
| O | 0.082 | 1.34 | 2.44 | 0.02 | 0.012 | 0.03 | 0.005 | 0.02 | — | — |
| P | 0.056 | 1.56 | 2.45 | 0.01 | 0.009 | 0.03 | 0.002 | 0.01 | 0.26 | As: 0.007, Sb: 0.04 |
| Q | 0.083 | 1.46 | 3.14 | 0.01 | 0.004 | 0.05 | 0.005 | 0.02 | 0.14 | Co: 0.012, Sn: 0.004 |
| R | 0.063 | 1.52 | 2.63 | 0.02 | 0.015 | 0.04 | 0.0006 | 0.01 | 0.15 | REM: 0.45 |
| S | 0.142 | 0.92 | 2.01 | 0.01 | 0.011 | 0.05 | 0.002 | 0.01 | 0.06 | Zn: 0.05, V: 0.06 |
| T | 0.094 | 0.76 | 2.55 | 0.01 | 0.005 | 0.08 | 0.005 | 0.02 | 0.04 | W: 0.012, Ni: 0.01 |
| U | 0.065 | 1.65 | 2.62 | 0.02 | 0.016 | 0.09 | 0.001 | 0.02 | 0.17 | Ca: 0.0056 |
| V | 0.085 | 1.49 | 2.65 | 0.01 | 0.002 | 0.03 | 0.002 | 0.01 | 0.1 | Cu: 0.02 |
| W | 0.082 | 1.52 | 2.61 | 0.01 | 0.002 | 0.03 | — | — | 0.2 | — |

*Underlines indicate the outside of the scope of the present invention.

TABLE 2

| No. | Steel Symbol | Hot rolling: Slab heating temperature (° C.) | Hot rolling: Finishing temperature (° C.) | Hot rolling: Coiling temperature (° C.) | Cold rolling: Cold reduction ratio (%) | Annealing: Heating rate (° C./s)*1 |
|---|---|---|---|---|---|---|
| 1 | A | 1250 | 910 | 520 | 42 | 20 |
| 2 | A | 1250 | 910 | 520 | 42 | 18 |
| 3 | A | 1250 | 910 | 520 | 42 | 5 |
| 4 | B | 1250 | 910 | 520 | 42 | 15 |
| 5 | B | 1250 | 910 | 520 | 42 | 15 |
| 6 | B | 1250 | 910 | 520 | 42 | 18 |
| 7 | B | 1250 | 910 | 520 | 42 | 18 |
| 8 | C | 1250 | 910 | 520 | 42 | 16 |
| 9 | C | 1250 | 910 | 520 | 42 | 16 |
| 10 | D | 1250 | 910 | 520 | 42 | 16 |
| 11 | D | 1250 | 910 | 520 | 42 | 16 |
| 12 | D | 1250 | 910 | 520 | 42 | 16 |
| 13 | E | 1250 | 910 | 520 | 42 | 13 |
| 14 | F | 1250 | 910 | 520 | 42 | 13 |
| 15 | G | 1250 | 910 | 520 | 42 | 15 |
| 16 | G | 1250 | 910 | 520 | 42 | 15 |
| 17 | G | 1250 | 910 | 520 | 42 | 15 |
| 18 | H | 1250 | 910 | 520 | 42 | 16 |
| 19 | I | 1250 | 910 | 520 | 42 | 16 |
| 20 | I | 1250 | 910 | 520 | 42 | 16 |
| 21 | J | 1250 | 910 | 520 | 42 | 13 |
| 22 | K | 1250 | 910 | 520 | 42 | 13 |
| 23 | L | 1250 | 910 | 520 | 42 | 15 |
| 24 | L | 1250 | 910 | 520 | 42 | 15 |
| 25 | L | 1250 | 910 | 520 | 42 | 15 |
| 26 | M | 1250 | 910 | 500 | 40 | 20 |
| 27 | N | 1250 | 920 | 500 | 40 | 20 |
| 28 | 0 | 1250 | 900 | 490 | 45 | 20 |
| 29 | P | 1250 | 900 | 500 | 45 | 20 |
| 30 | 0 | 1250 | 910 | 520 | 50 | 20 |
| 31 | R | 1250 | 890 | 500 | 50 | 20 |
| 32 | S | 1250 | 900 | 500 | 45 | 20 |
| 33 | T | 1250 | 920 | 510 | 52 | 20 |
| 34 | U | 1250 | 910 | 520 | 52 | 20 |
| 35 | V | 1250 | 910 | 520 | 53 | 20 |
| 36 | W | 1250 | 910 | 520 | 53 | 20 |

| No. | Annealing: Annealing temperature (° C.) | Annealing: Annealing time (s) | Annealing: Number of times of bending-unbending with roll of 100 mm or more radius | Annealing: Average cooling rate (° C./s)*2 | Annealing: Cooling termination temperature (° C.) | Note |
|---|---|---|---|---|---|---|
| 1 | 830 | 80 | 4 | 15 | 500 | Example steel |
| 2 | 830 | 80 | 4 | 15 | 500 | Example steel |
| 3 | 830 | 80 | 4 | 15 | 500 | Comparative steel |
| 4 | 820 | 90 | 5 | 20 | 480 | Example steel |
| 5 | 820 | 80 | 4 | 20 | 490 | Example steel |
| 6 | 810 | 25 | 5 | 13 | 500 | Comparative steel |
| 7 | 810 | 260 | 5 | 13 | 500 | Comparative steel |
| 8 | 800 | 65 | 4 | 12 | 480 | Example steel |
| 9 | 800 | 68 | 3 | 20 | 500 | Example steel |
| 10 | 800 | 92 | 5 | 15 | 540 | Example steel |
| 11 | 800 | 70 | 8 | 15 | 540 | Comparative steel |
| 12 | 800 | 70 | 1 | 15 | 540 | Comparative steel |
| 13 | 850 | 85 | 4 | 15 | 520 | Comparative steel |
| 14 | 840 | 90 | 4 | 14 | 520 | Comparative steel |
| 15 | 810 | 70 | 5 | 15 | 530 | Example steel |
| 16 | 710 | 75 | 5 | 15 | 490 | Comparative steel |
| 17 | 940 | 90 | 5 | 16 | 520 | Comparative steel |
| 18 | 820 | 90 | 3 | 15 | 520 | Example steel |
| 19 | 820 | 90 | 3 | 17 | 490 | Example steel |
| 20 | 820 | 85 | 3 | 8 | 510 | Comparative steel |
| 21 | 810 | 90 | 4 | 17 | 510 | Comparative steel |
| 22 | 820 | 75 | 5 | 17 | 500 | Comparative steel |
| 23 | 820 | 85 | 5 | 17 | 500 | Example steel |
| 24 | 820 | 85 | 5 | 16 | 320 | Comparative steel |
| 25 | 820 | 85 | 5 | 18 | 670 | Comparative steel |
| 26 | 810 | 80 | 4 | 15 | 510 | Comparative steel |
| 27 | 820 | 85 | 4 | 16 | 510 | Comparative steel |
| 28 | 820 | 83 | 4 | 17 | 500 | Comparative steel |

TABLE 2-continued

| | | | | | | |
|---|---|---|---|---|---|---|
| 29 | 810 | 80 | 4 | 16 | 500 | Example steel |
| 30 | 820 | 80 | 4 | 21 | 490 | Example steel |
| 31 | 820 | 80 | 4 | 17 | 490 | Example steel |
| 32 | 850 | 80 | 4 | 16 | 490 | Example steel |
| 33 | 820 | 80 | 4 | 15 | 490 | Example steel |
| 34 | 850 | 80 | 4 | 13 | 490 | Example steel |
| 35 | 850 | 80 | 4 | 15 | 490 | Example steel |
| 36 | 850 | 80 | 4 | 15 | 490 | Example steel |

*Underlines indicate the outside of the scope of the present invention.

*1: Average heating rate in the temperature range of ($A_c1$-50° C.) to $A_c1$

*2: Average cooling rate in cooling after retention in the annealing temperature range (1) Microstructure Observation A cross-section in the thickness direction perpendicular to the rolling direction of each obtained steel sheet was polished and etched with 1% Nital to expose the microstructure. Ten fields of view were imaged within a region from the surface to a ¼t portion in the thickness direction under a scanning electron microscope at a magnification of 2,000×, and intercept procedures in accordance with ASTM E 112-10 were employed. The letter t represents the thickness of a steel sheet (sheet thickness). On the basis of the above-mentioned images, an area ratio of each phase was determined. A ferrite phase is a microstructure in which no etch mark or cementite is observed inside the grains, and a bainite phase is a microstructure in which etch marks and/or large carbides are observed inside the grains. In untempered martensite, no cementite is observed inside the grains, and the gradation is brighter than that of the ferrite phase. Tempered martensite is a microstructure in which etch marks and/or cementite are observed inside the grains. For these phases, an average area ratio relative to the observed fields of view was obtained by image analysis. To distinguish martensite and retained austenite, the measurement of retained austenite was performed by quantifying a volume ratio of a retained austenite phase by using X-ray diffraction intensities of a surface prepared through grinding to a ¼ position in the thickness direction and then through chemical polishing of 200 μm or more. MoKα radiation was used as an incident source, and the volume ratio was measured from (200)α, (211)α, (220)α, (200)γ, (220)γ, and (311)γ peaks. The obtained volume ratio value of the retained austenite phase was regarded as an area ratio value in the steel sheet microstructure. A martensite area ratio in accordance with aspects of the present invention is regarded as a value obtained by subtracting an area ratio of retained austenite from an area ratio of untempered martensite and by adding an area ratio of tempered martensite. Here, pearlite was observed as another phase.

By using the above-mentioned images used for obtaining the volume fraction, an average grain size of martensite and an average grain size of ferrite were obtained by imaging ten fields of view under a scanning electron microscope (SEM) at a magnification of 1,000× and by employing intercept procedures in accordance with ASTM E 112-10. The calculated average grain sizes of martensite and ferrite are shown in Table 3.

(2) Tensile Properties

Average yield strength (YP), tensile strength (TS), and total elongation (EL) were obtained by performing a tensile test in accordance with JIS Z 2241 five times for No. 5 specimens according to JIS Z 2201, whose longitudinal direction (tensile direction) is a direction perpendicular to the rolling direction. The calculated results are shown in Table 3. YP of 550 MPa or higher is evaluated as satisfactory.

TS of 980 MPa or higher is preferable, and El of 16% or more is preferable.

The differences in material properties between the central portion and the end portion in the width direction are also shown in Table 3. ΔYP of 15 MPa or less, ΔTS of 20 MPa or less, and ΔEl of 3.0% or less are evaluated as satisfactory.

(3) Measurement of Amount of Springback (Angle)

Figure 2:
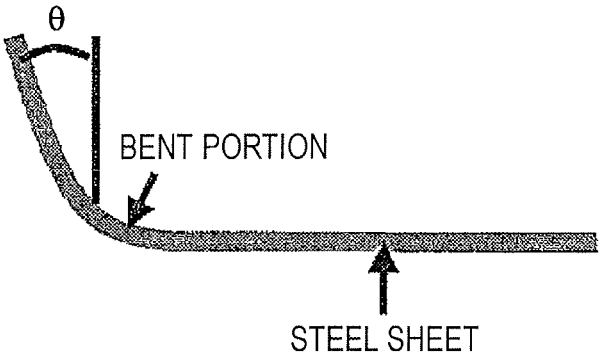
FIG. 2 is a schematic view for illustrating the springback angle.

A specimen was prepared by cutting out a steel sheet of 35 mm-width and 100 mm-length so that the longitudinal direction is a direction parallel to the rolling direction. The prepared specimen underwent an L-bending test with pushing and bending implement (punch and others) as illustrated in FIG. 1 at a forming load of 10 kN, a loading rate of 100 mm/min, and a bend radius R of 4 mm. The θ value of FIG. 2 is regarded as a springback angle. These results are collectively shown in Table 3. θ of 9.0° or less is evaluated as satisfactory. The differences between the central portion and the end portion in the width direction are also shown in Table 3. Δθ of 2.5° or less is evaluated as satisfactory.

TABLE 3

| | Characteristics of steel sheet microstructure | | | | | | Properties of steel sheet of central portion in width-direction | |
|---|---|---|---|---|---|---|---|---|
| | | Martensite phase | | Ferrite phase | | Ferrite average | | |
| No. | Bainite phase Bainite area fraction (%) | Martensite area fraction (%) | Average grain size (μm) | Ferrite area fraction (%) | Average grain size (μm) | grain size/martensite average grain size | YP (MPa) | TS (MPa) |
| 1 | 12 | 50 | 6 | 34 | 8 | 1.3 | 645 | 1030 |
| 2 | 13 | 48 | 7 | 35 | 7 | 1.0 | 650 | 1025 |
| 3 | 3 | 45 | 7 | 50 | 22 | 3.1 | 500 | 870 |
| 4 | 14 | 52 | 6 | 31 | 8 | 1.3 | 650 | 1020 |
| 5 | 14 | 53 | 6 | 30 | 9 | 1.5 | 650 | 1025 |
| 6 | 4 | 40 | 5 | 55 | 16 | 3.2 | 490 | 860 |
| 7 | 6 | 42 | 10 | 46 | 15 | 1.5 | 670 | 1030 |
| 8 | 18 | 50 | 6 | 30 | 10 | 1.7 | 690 | 1050 |

TABLE 3-continued

| | | | | | | | | |
|---|---|---|---|---|---|---|---|---|
| 9 | 16 | 52 | 7 | 31 | 10 | 1.4 | 685 | 1045 |
| 10 | 10 | 65 | 7 | 21 | 9 | 1.3 | 710 | 1070 |
| 11 | 3 | 71 | 8 | 20 | 10 | 1.3 | 720 | 1080 |
| 12 | 4 | 70 | 11 | 25 | 15 | 1.4 | 705 | 1065 |
| 13 | 3 | 40 | 7 | 56 | 14 | 2.0 | 530 | 860 |
| 14 | 3 | 80 | 12 | 15 | 13 | 1.1 | 715 | 1075 |
| 15 | 16 | 50 | 7 | 30 | 8 | 1.1 | 670 | 1030 |
| 16 | 3 | 30 | 5 | 60 | 14 | 2.8 | 510 | 870 |
| 17 | 6 | 75 | 13 | 11 | 9 | 0.7 | 790 | 1150 |
| 18 | 20 | 50 | 6 | 28 | 9 | 1.5 | 695 | 1055 |
| 19 | 10 | 50 | 5 | 38 | 9 | 1.8 | 650 | 1010 |
| 20 | 25 | 33 | 6 | 40 | 19 | 3.2 | 505 | 860 |
| 21 | 4 | 65 | 9 | 25 | 12 | 1.3 | 720 | 1080 |
| 22 | 6 | 40 | 9 | 52 | 15 | 1.7 | 535 | 950 |
| 23 | 15 | 45 | 6 | 36 | 8 | 1.3 | 675 | 1035 |
| 24 | 10 | 30 | 6 | 53 | 10 | 1.7 | 520 | 880 |
| 25 | 8 | 38 | 7 | 50 | 21 | 3.0 | 525 | 885 |
| 26 | 11 | 35 | 6 | 52 | 20 | 3.3 | 510 | 890 |
| 27 | 3 | 38 | 6 | 55 | 19 | 3.2 | 525 | 1010 |
| 28 | 10 | 50 | 12 | 38 | 15 | 1.3 | 655 | 1015 |
| 29 | 11 | 42 | 7 | 43 | 9 | 1.3 | 655 | 1015 |
| 30 | 12 | 60 | 7 | 26 | 9 | 1.3 | 705 | 1066 |
| 31 | 10 | 43 | 6 | 40 | 10 | 1.7 | 660 | 1020 |
| 32 | 13 | 65 | 7 | 20 | 9 | 1.3 | 730 | 1090 |
| 33 | 11 | 50 | 6 | 37 | 9 | 1.5 | 670 | 1030 |
| 34 | 9 | 50 | 6 | 38 | 8 | 1.3 | 665 | 1025 |
| 35 | 15 | 55 | 6 | 25 | 9 | 1.5 | 690 | 1050 |
| 36 | 14 | 50 | 6 | 27 | 9 | 1.5 | 680 | 1040 |

| | Properties of steel sheet of central portion in width-direction | | Differences in material properties between end portion and central portion in width direction | | | | |
|---|---|---|---|---|---|---|---|
| No. | EL (%) | Amount of springback θ (°) | ΔYP (MPa) | ΔTS (MPa) | ΔEI (%) | Δθ (°) | Note |
| 1 | 17.9 | 8.0 | 8.0 | 12.0 | 0.5 | 2.0 | Example steel |
| 2 | 18.0 | 7.5 | 9.0 | 11.0 | 0.3 | 1.5 | Example steel |
| 3 | 20.8 | 8.5 | 16.0 | 25.0 | 3.5 | 4.0 | Comparative steel |
| 4 | 18.1 | 8.0 | 7.0 | 9.0 | 0.6 | 1.6 | Example steel |
| 5 | 18.0 | 7.9 | 8.0 | 10.0 | 0.4 | 2.1 | Example steel |
| 6 | 20.9 | 8.5 | 20.0 | 35.0 | 3.8 | 5.0 | Comparative steel |
| 7 | 14.0 | 9.5 | 18.0 | 30.0 | 3.2 | 4.5 | Comparative steel |
| 8 | 17.6 | 7.5 | 8.0 | 11.0 | 0.6 | 1.5 | Example steel |
| 9 | 17.7 | 7.3 | 9.0 | 12.0 | 0.6 | 1.9 | Example steel |
| 10 | 17.3 | 7.5 | 7.0 | 9.0 | 0.5 | 2.0 | Example steel |
| 11 | 17.1 | 8.0 | 25.0 | 40.0 | 4.5 | 5.0 | Comparative steel |
| 12 | 17.4 | 7.6 | 22.0 | 38.0 | 4.0 | 5.5 | Comparative steel |
| 13 | 21.2 | 8.5 | 18.0 | 30.0 | 3.5 | 4.6 | Comparative steel |
| 14 | 17.2 | 8.5 | 22.0 | 39.0 | 4.0 | 6.0 | Comparative steel |
| 15 | 18.0 | 7.2 | 8.0 | 10.0 | 0.7 | 1.2 | Example steel |
| 16 | 20.6 | 8.0 | 25.0 | 35.0 | 3.4 | 5.0 | Comparative steel |
| 17 | 15.5 | 10.0 | 20.0 | 32.0 | 3.8 | 5.5 | Comparative steel |
| 18 | 17.5 | 7.5 | 7.0 | 10.0 | 1.1 | 1.5 | Example steel |
| 19 | 18.3 | 7.6 | 7.0 | 12.0 | 0.7 | 1.0 | Example steel |
| 20 | 21.1 | 8.3 | 18.0 | 28.0 | 4.0 | 5.8 | Comparative steel |
| 21 | 17.1 | 8.7 | 23.0 | 39.0 | 3.8 | 6.3 | Comparative steel |
| 22 | 19.5 | 8.0 | 16.0 | 22.0 | 3.1 | 4.0 | Comparative steel |
| 23 | 17.9 | 8.5 | 9.0 | 13.0 | 1.0 | 2.0 | Example steel |
| 24 | 18.6 | 8.0 | 22.0 | 33.0 | 3.5 | 5.6 | Comparative steel |
| 25 | 20.9 | 8.1 | 26.0 | 38.0 | 3.6 | 6.0 | Comparative steel |
| 26 | 20.8 | 8.3 | 21.0 | 35.0 | 3.8 | 5.8 | Comparative steel |
| 27 | 18.3 | 8.0 | 20.0 | 32.0 | 3.4 | 5.0 | Comparative steel |
| 28 | 18.2 | 8.2 | 28.0 | 42.0 | 3.8 | 6.0 | Comparative steel |
| 29 | 18.2 | 7.5 | 9.0 | 15.0 | 0.6 | 1.2 | Example steel |
| 30 | 17.4 | 8.0 | 7.0 | 12.0 | 0.5 | 0.9 | Example steel |
| 31 | 18.1 | 7.5 | 8.0 | 15.0 | 0.6 | 1.2 | Example steel |
| 32 | 17.0 | 8.0 | 6.0 | 13.0 | 0.6 | 1.6 | Example steel |
| 33 | 18.0 | 7.5 | 5.0 | 10.0 | 0.4 | 1.8 | Example steel |
| 34 | 18.0 | 7.3 | 8.0 | 11.0 | 0.9 | 1.5 | Example steel |
| 35 | 17.6 | 7.6 | 9.0 | 10.0 | 0.8 | 1.6 | Example steel |
| 36 | 17.8 | 7.6 | 9.0 | 10.0 | 0.8 | 1.6 | Example steel |

*Underlines indicate the outside of the scope of the present invention.

The invention claimed is:

1. A high-strength steel sheet having a yield strength (YP) of 550 MPa or higher and having:

a component composition containing, in mass %,

C: 0.05 to 0.15%,

Si: 0.010 to 2.0%,

Mn: 1.8 to 3.2%,

P: 0.05% or less,

S: 0.02% or less,

Al: 0.01 to 2.0%, and

Mo: 0.03 to 0.50%, with the balance being Fe and incidental impurities; and a microstructure containing 5 to 40% of a ferrite phase in area ratio, 40 to 70% of a martensite phase in area ratio, and 5 to 30% of a bainite phase in area ratio, wherein: an average grain size of the martensite phase is 5 to 8 μm and an average grain size of the ferrite phase is 6 to 11 μm on a cross-section in the thickness direction and in a direction orthogonal to a rolling direction; and the average grain size of the ferrite phase is 3.0 times or less the average grain size of martensite; and wherein differences in material properties between an end portion and a central portion in a width direction of the high-strength steel sheet are ΔYP of 15 MPa or less, ΔTS of 20 MPa or less, ΔEl of 3.0% or less, and Δθ of 2.5 or less.

2. The high-strength steel sheet according to claim 1, wherein the component composition further contains, in mass %, at east one of, B: 0.0001 to 0.005%, Ti: 0.005 to 0.04%, and Cr: 0%.

3. The high-strength steel sheet according to claim 1, wherein the component composition further contains, in mass %, 1% or less in total of any one or more of Cu, Ni, Sn, As, Sb, Ca, Mg, Pb, Co, Ta, W, REM, Zn, Sr, Cs, Hf, V, and Nb.

4. The high-strength steel sheet according to claim 1, wherein the steel sheet has a coated layer on a surface.

5. The high-strength steel sheet according to claim 4, wherein the coated layer is a hot-dip galvanized layer.

6. A manufacturing method for a high-strength steel sheet, comprising an annealing step including: heating a cold-rolled steel sheet having the component composition according to claim 1 to an annealing temperature under conditions of an average heating rate of 10°C./s is or more in a temperature range of ($A_{c1}$−50° C.) to $A_{c1}$; annealing under conditions of an annealing temperature of 750° C. to 900° C. for an annealing time of 30 to 200 seconds; cooling to 400° C. to 600° C. at an average cooling rate of 10° C./s to 40° C./s; and performing, during the cooling, bending-unbending two times or more and six times or less in total by using a roll having a radius of 100 mm or more; thereby producing the high-strength steel sheet of claim 1.

7. The manufacturing method for a high-strength steel sheet according to claim 6, further comprising, after the annealing step, a coating step of performing a coating process.

8. The high-strength steel sheet according to claim 2, wherein the component composition further contains, in mass %, 1% or less in total of any one or more of Cu, Ni, Sn, As, Sb, Ca, Mg, Pb, Co, Ta, W, REM, Zn, Sr, Cs, Hf, V, and Nb.

9. The high-strength steel sheet according to claim 2, wherein the steel sheet has a coated layer on a surface.

10. The high-strength steel sheet according to claim 3, wherein the steel sheet has a coated layer on a surface.

11. The high-strength steel sheet according to claim 8, wherein the steel sheet has a coated layer on a surface.

12. The high-strength steel sheet according to claim 9, wherein the coated layer is a hot-dip galvanized layer.

13. The high-strength steel sheet according to claim 10, wherein the coated layer is a hot-dip galvanized layer.

14. The high-strength steel sheet according to claim 11, wherein the coated layer is a hot-dip galvanized layer.

15. A manufacturing method for a high-strength steel sheet, comprising an annealing step including: heating a cold-rolled steel sheet having the component composition according to claim 2 to an annealing temperature under conditions of an average heating rate of 10° C./s or more in a temperature range of ($A_{c1}$−50° C.) to $A_{cl}$; annealing under conditions of an annealing temperature of 750° C. to 900° C. for an annealing time of 30 to 200 seconds; cooling to 400° C. to 600° C. at an average cooling rate of 10° C./s to 40° C./s; and performing, during the cooling, bending-unbending two times or more and six times or less in total by using a roll having a radius of 100 mm or more; thereby producing the high-strength steel sheet of claim 2.

16. A manufacturing method for a high-strength steel sheet, comprising an annealing step including: heating a cold-rolled steel sheet having the component composition according to claim 5 to an annealing temperature under conditions of an average heating rate of 10° C./s or more in a temperature range of ($A_{c1}$−50° C.) to $A_{c1}$; annealing under conditions of an annealing temperature of 750° C. to 900° C. for an annealing time of 30 to 200 seconds; cooling to 400° C. to 600° C. at an average cooling rate of 10° C./s to 40° C./s; and performing, during the cooling, bending-unbending two times or more and six times or less in total by using a roll having a radius of 100 mm or more; thereby producing the high-strength steel sheet of claim 3.

17. A manufacturing method for a high-strength steel sheet, comprising an annealing step including: heating a cold-rolled steel sheet having the component composition according to claim 10 to an annealing temperature under conditions of an average heating rate of 10° C./s or more in a temperature range of ($A_{c1}$−50° C.) to $A_{c1}$; annealing under conditions of an annealing temperature of 750° C. to 900° C. for an annealing time of 30 to 200 seconds; cooling to 400° C. to 600° C. at an average cooling rate of 10° C./s to 40° C./s; and performing, during the cooling, bending-unbending two times or more and six times or less in total by using a roll having a radius of 100 mm or more; thereby producing the high-strength steel sheet of claim 8.

18. The manufacturing method for a high-strength steel sheet according to claim 15, further comprising, after the annealing step, a coating step of performing a coating process.

19. The manufacturing method for a high-strength steel sheet according to claim 16, further comprising, after the annealing step, a coating step of performing a coating process.

20. The manufacturing method for a high-strength steel sheet according to claim 17, further comprising, after the annealing step, a coating step of performing a coating process.

* * * * *